US009893430B2

(12) United States Patent
Wang et al.

(10) Patent No.: US 9,893,430 B2
(45) Date of Patent: Feb. 13, 2018

(54) SHORT COINCIDENT PHASED SLOT-FED DUAL POLARIZED APERTURE

(71) Applicant: RAYTHEON COMPANY, Waltham, CA (US)

(72) Inventors: Allen T. S. Wang, Fullerton, CA (US); Fangchou Yang, Los Angeles, CA (US); Jar J. Lee, Irvine, CA (US); Jason G. Milne, Hawthorne, CA (US)

(73) Assignee: RAYTHEON COMPANY, Waltham, MA (US)

( * ) Notice: Subject to any disclaimer, the term of this patent is extended or adjusted under 35 U.S.C. 154(b) by 402 days.

(21) Appl. No.: 14/029,643

(22) Filed: Sep. 17, 2013

(65) Prior Publication Data

US 2015/0077300 A1 Mar. 19, 2015

(51) Int. Cl.

| | |
|---|---|
| ***H01Q 13/10*** | (2006.01) |
| ***H01Q 13/18*** | (2006.01) |
| ***H01Q 13/08*** | (2006.01) |
| ***H01Q 21/06*** | (2006.01) |
| ***H01Q 21/24*** | (2006.01) |

(52) U.S. Cl.

CPC ..... *H01Q 13/106* (2013.01); *H01Q 13/085* (2013.01); *H01Q 13/18* (2013.01); *H01Q 21/064* (2013.01); *H01Q 21/24* (2013.01)

(58) Field of Classification Search

CPC .... H01Q 13/085; H01Q 13/18; H01Q 13/106; H01Q 21/064; H01Q 21/24

USPC ..... 343/770, 771, 795

See application file for complete search history.

(56) References Cited

U.S. PATENT DOCUMENTS

| | | | |
|---|---|---|---|
| 2,628,311 | A | 2/1953 | Lindenblad |
| 5,828,345 | A | 10/1998 | Waterman et al. |
| 6,867,742 | B1 | 3/2005 | Irion, II et al. |
| 2002/0163469 | A1 | 11/2002 | Waterman |
| 2005/0007286 | A1 | 1/2005 | Trott et al. |
| 2006/0290584 | A1 | 12/2006 | Fontana |

OTHER PUBLICATIONS

Written Opinion of the International Searching Authority for International Application No. PCT/US2014/049707, filed Aug. 5, 2014, Written Opinion of the International Searching Authority dated Nov. 4, 2014 (7 pgs.).

(Continued)

*Primary Examiner* — Graham Smith
*Assistant Examiner* — Noel Maldonado
(74) *Attorney, Agent, or Firm* — Lewis Roca Rothgerber Christie LLP

(57) ABSTRACT

A coincident phased dual-polarized antenna array configured to emit electromagnetic radiation includes: a plurality of electromagnetic radiators arranged in a grid, the plurality of electromagnetic radiators defining a plurality of notches; a ground plane spaced from the electromagnetic radiators; a conductive layer disposed between the electromagnetic radiators and the ground plane, the conductive layer having a plurality of slots laterally offset from the notches and being spaced apart from and electrically insulated from the electromagnetic radiators; and a plurality of feeds, each of the feeds spanning a corresponding slot of the slots and electrically connected to a portion of the conductive layer at one side of the corresponding slot.

20 Claims, 14 Drawing Sheets

(56) References Cited

OTHER PUBLICATIONS

International Search Report for International Application No. PCT/US2014/049707, filed Aug. 5, 2014, International Search Report dated Oct. 9, 2014 and dated Nov. 4, 2014 (8 pgs.).
Pickles, et al. "Coincident Phase Center Ultra Wideband Array of Dual Polarized Flared Notch Elements", IEEE, 2007 (pp. 4421-4424).
Trott, et al. "7-21 GHz Wideband Phased Array Radiator", IEEE, 2004 (pp. 2265-2268).
Trott, et al. "Wideband Phased Array Radiator", IEEE, 2003 (pp. 383-386).

SHORT COINCIDENT PHASED SLOT-FED DUAL POLARIZED APERTURE

BACKGROUND

1. Field

Embodiments of the present invention relate to antenna arrays.

2. Related art

Dual polarity flared notch antennas arrays are commonly used, for example, in radar systems. For some applications, it is desirable for the two polarities of the dual polarity flared notch antenna array to have coincident phase centers.

FIG. 1A is a cross sectional view of a conventional flared notch antenna 100 having two flares 110, a feed 120 crossing a notch 130 located between the two flares 110 and backed by a cavity 140. Due to the location of the feed 120 across the notch 130, a conventional flared notch antenna 100 cannot be operated in a dual polarity arrangement with coincident phase centers because the flares 110 and the feed 120 of the second polarity would interfere (e.g., intersect or cross) with those of the first polarity.

FIG. 1B is a cross sectional view illustrating a conventional flared notch antenna 100' having an alternative feed scheme including an alternative feed 120'.

FIGS. 2A and 2B are cross sectional views of alternative flared notch antennas which can be used to provide a coincident phased dual polarity flared notch antenna array. FIG. 2A is reproduced from FIG. 2 of W. R. Pickles, et al. "Coincident Phase Center Ultra Wideband Array of Dual Polarized Flared Notch Elements" Antennas and Propagation Society International Symposium, IEEE 2007. In the antenna arrays shown in FIGS. 2A and 2B, the feed 220 is split into a first and a second feed 222 and 224. Similarly, the notch 230 is split into first and second slots 232 and 234 which are backed by their respective cavities 242 and 244. The first and second feeds 222 and 224 extend across their respective slots 232 and 234. Because the feed 220 no longer crosses the center of the structure (e.g., in the middle of the space between the flares 210), this structure makes it possible to arrange flares and feeds for both the first and second polarities without the use of an offset in the z-direction.

In addition to a balun, an impedance transformer is generally used as part of a radiating element in order to provide impedance matching between the source impedance (generally, 50Ω) and the free space impedance (approximately 377Ω). In the conventional flared notch radiator 100 illustrated in FIG. 1A, the flares 110 are used as the impedance transformer to provide this impedance matching. However, because the flares 110 are directly connected to the feed 120, the flares must provide all of the matching from 50Ω to 377Ω and therefore are relatively long.

SUMMARY

Embodiments of the present invention are directed to a short coincident phased slot-fed dual polarized aperture phased antenna array.

According to one embodiment of the present invention, a coincident phased dual-polarized antenna array configured to emit electromagnetic radiation includes: a plurality of electromagnetic radiators arranged in a grid, the plurality of electromagnetic radiators defining a plurality of notches; a ground plane spaced from the electromagnetic radiators; a conductive layer disposed between the electromagnetic radiators and the ground plane, the conductive layer having a plurality of slots laterally offset, from the notches and being spaced apart from and electrically insulated from the electromagnetic radiators; and a plurality of feeds, each of the feeds spanning a corresponding slot of the slots and electrically connected to a portion of the conductive layer at one side of the corresponding slot.

The ground plane may be spaced from the conductive layer.

A spacer layer may be between the plurality of slots and the ground plane.

The spacer layer may be filled with a dielectric material.

A plurality of cavities may be between the plurality of slots and the ground plane.

The cavities may be filled with a dielectric material.

The conductive layer may be spaced apart from the electromagnetic radiators by an electrically insulating parallel plate layer.

The electrically insulating parallel plate layer may be filled with a dielectric material.

One of the slots may be located between adjacent ones of the notches.

Two of the slots may be located between adjacent ones of the notches.

A first of the feeds spanning a first slot of the slots may be electrically coupled in parallel to a second of the feeds spanning a second slot of the slots, wherein the first slot may be adjacent to the second slot, and wherein the first slot and the second slot may be on opposite sides of a notch of the notches.

The electromagnetic radiators may include metalized molded plastic flares.

The feeds may be microstrip feeds.

The feeds may be stripline feeds.

According to another embodiment of the present invention, a method of emitting electromagnetic radiation along a plurality of radiating paths includes: providing a plurality of electromagnetic radiators arranged in a grid, the plurality of electromagnetic radiators defining a plurality of notches; providing a ground plane spaced from the electromagnetic radiators; providing a conductive layer between the electromagnetic radiators and the ground plane, the conductive layer having a plurality of slots laterally offset from the notches and being spaced apart from and electrically insulated from the electromagnetic radiators; providing a plurality of feeds, each of the feeds spanning a corresponding slot of the slots and electrically connected to a portion of the conductive layer at one side of the corresponding slot; and supplying a plurality of electromagnetic signals to the feeds.

Two of the slots may be located between adjacent ones of the notches.

A first of the feeds spanning a first slot of the slots may be electrically coupled in parallel with a second of the feeds spanning a second slot of the slots, wherein the first slot may be adjacent to the second slot, wherein the first slot and the second slot may be on opposite sides of a radiating path of the radiating paths, and wherein a same electromagnetic signal of the electromagnetic signals may be supplied to the first micro strip line or strip line feed and the second micro strip line or strip line feed.

The feeds may be microstrip feeds.

The feeds are stripline feeds.

The method may further include providing a spacer layer or a plurality of cavities between the plurality of slots and the ground plane.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1B:
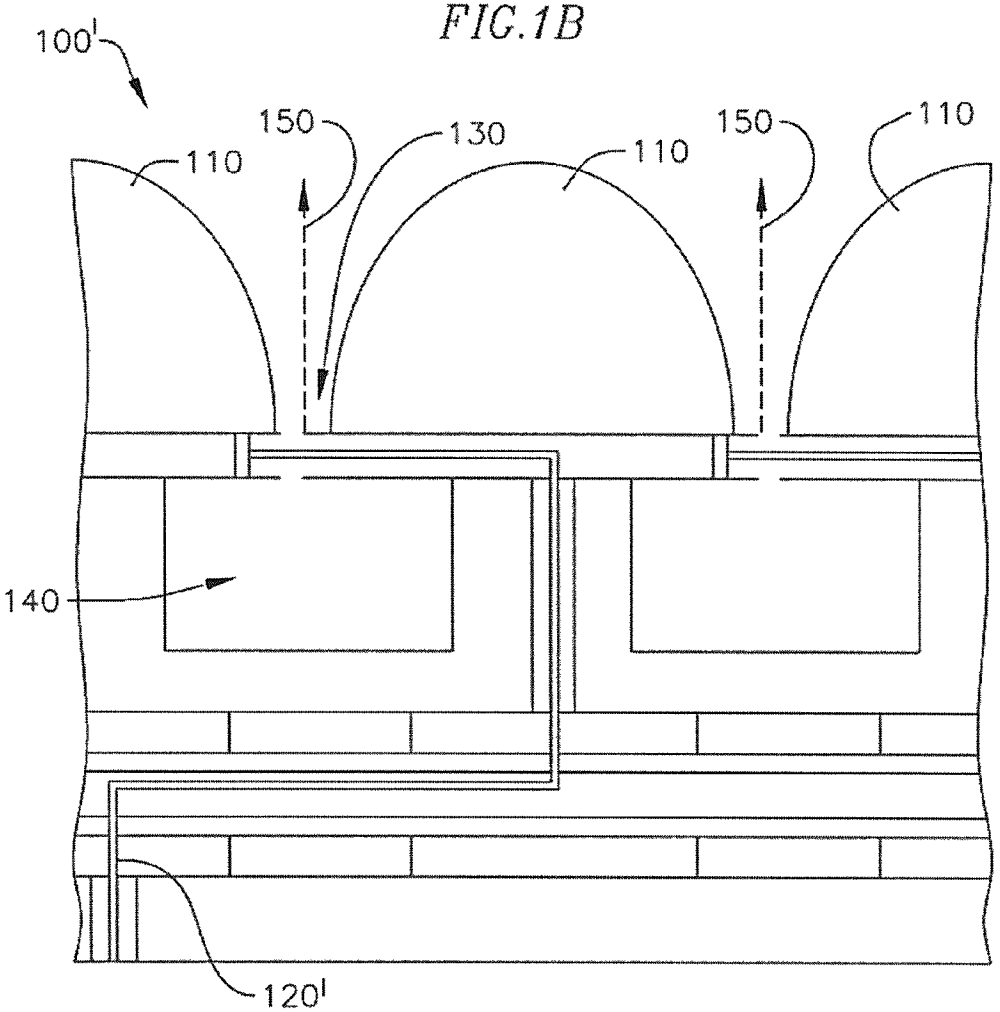
FIG. 1B is a cross sectional view illustrating a conventional flared notch antenna having an alternative feed scheme.
Figure 1A:
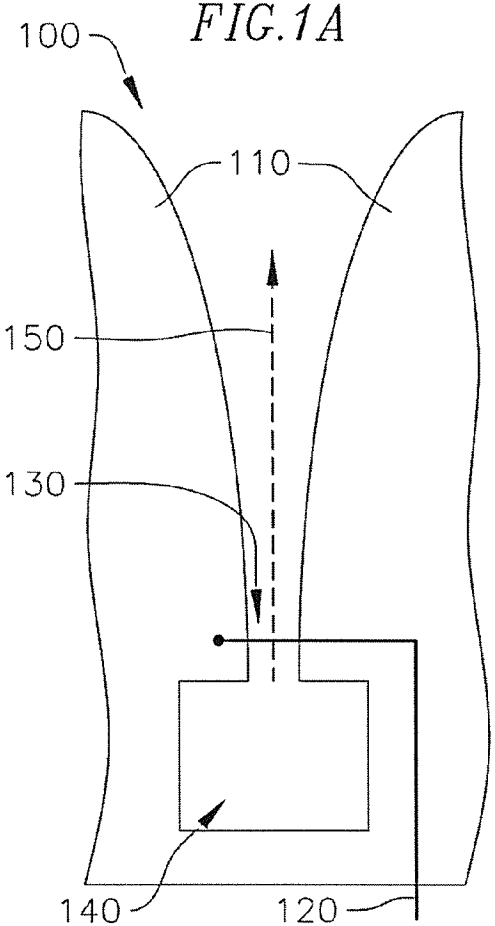
FIG. 1A is a cross-sectional view of a conventional flared notch antenna which may be used in a dual polarized arrangement.
Figure 2B:
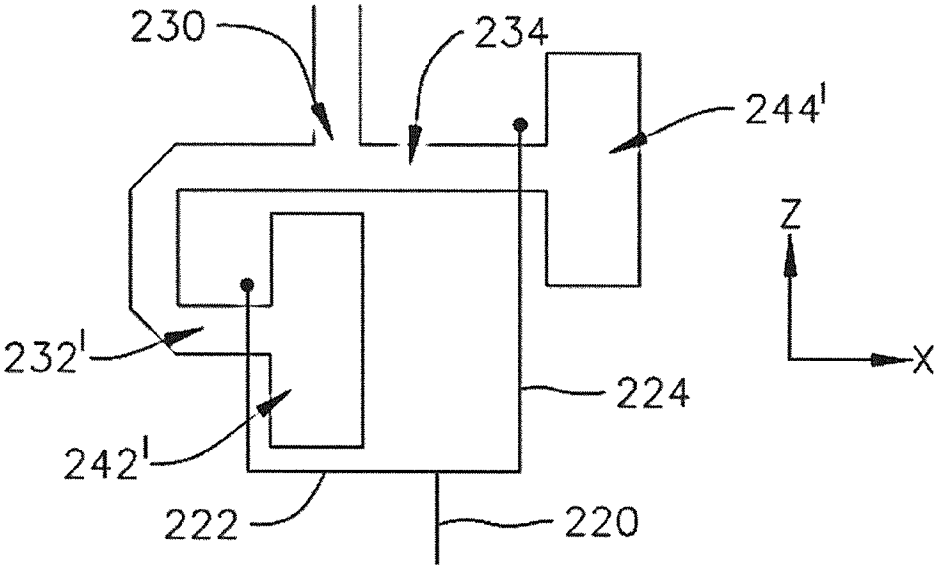
FIG. 2B is a cross-sectional view of a prior coincident phased radiator similar to that of FIG. 2A having an alternative feed scheme.
Figure 2A:
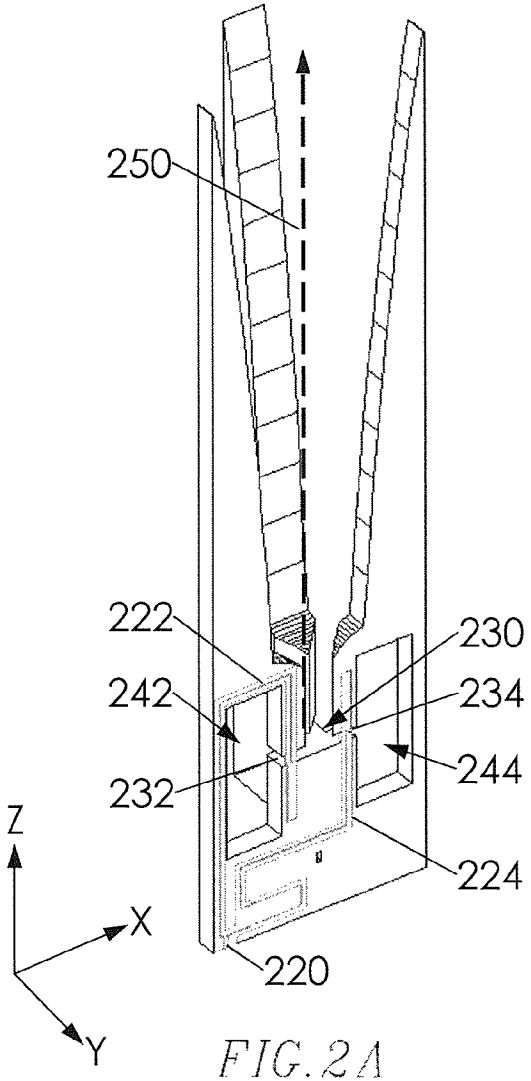
FIG. 2A is a cross-sectional view of a prior coincident phased radiator having a balanced feed and having feed lines running along two orthogonal planes.

In the following detailed description, only certain exemplary embodiments of the present invention are shown and described, by way of illustration. As those skilled in the art would recognize, the invention may be embodied in many different forms and should not be construed as being limited to the embodiments set forth herein. Also, in the context of the present application, when an element is referred to as being "on" another element, it can be directly on another element or be indirectly on another element with one or more intervening elements interposed there between. Like reference numerals designate like elements throughout the specification.

Many of today's sensors require coincident-phased dual polarization apertures with a wide scan capability and very wide bandwidth (e.g., >2:1 bandwidth). In addition, in lower frequency applications, an antenna array having a low profile and small volume is desirable due to weight and packaging constraints. Low loss is also a desirable characteristic for such applications. In addition, an antenna array having a simplified construction can reduce manufacturing costs.

However, as described in the Background section above, a conventional flared notch antenna is not well suited to applications requiring coincident-phased dual polarization apertures because the feed lines in any adaptation of the conventional design would interfere (e.g., intersect or cross).

Adapting a conventional flared notch antenna to provide a coincident-phased dual polarization aperture would require offsetting the feeds in the z-direction (e.g., in the antenna boresight direction) in order to provide space such that the feed lines 120 of each polarity do not interfere. However, such a configuration would be difficult to manufacture (due to, for example, the multiple layers required for the feed lines) and would likely exhibit higher cross-polarization coupling.

Embodiments of the present invention are directed to a flared notch antenna in which the feed lines are spaced apart from the radiating notch of the flares along a direction perpendicular to antenna boresight direction, thereby providing a coincident phased dual polarity element that is suited for both low-frequency and high-frequency applications. In embodiments of the present invention, a slot-fed balun is configured to drive radiating elements in a push-pull manner, where slot resonators are fed with a parallel plate structure.

In general, embodiments of the present invention are capable of wideband operation, have low loss, and have a simple construction. For the low-frequency applications, embodiments of the present invention are capable of wideband performance (simulated up to 3.5:1 bandwidth) in a very low profile and lightweight structure, and having low cross-polarization coupling.

Figure 3A:
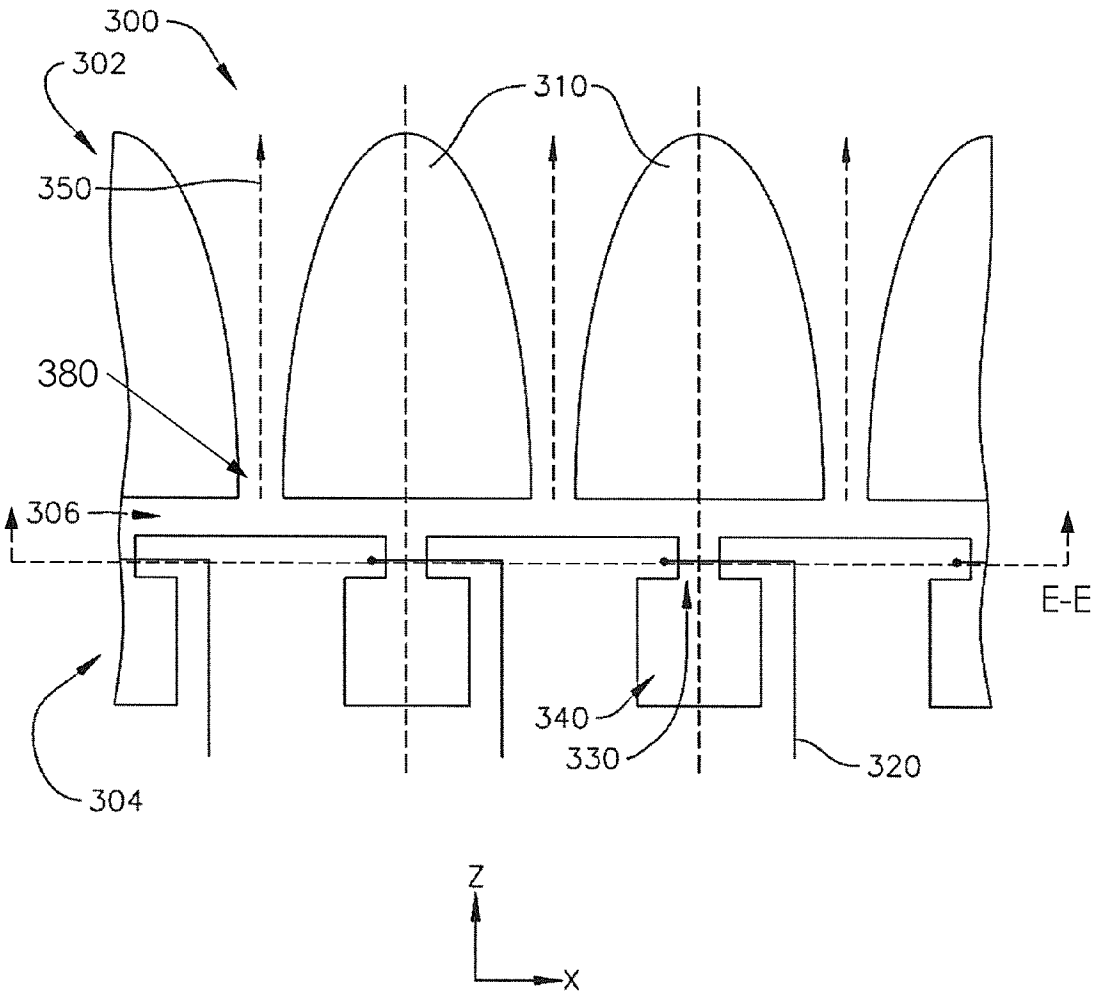
FIG. 3A is a cross sectional view a coincident phased slot fed antenna array according to one embodiment of the present invention.

FIG. 3A is a cross sectional view of a coincident phased slot-fed dual polarized antenna array with a single slot resonator according to one embodiment of the present invention. Embodiments making use of a single slot resonator may be used in higher-frequency applications where the height of a radiating portion 302 is not a major concern but physical packaging may be a limitation. In this embodiment, the overall height of the radiating portion 302 may be ~1 wavelength tall at the highest operating frequency. The flared slot sections transform from approximately 300 ohms down to a drive point impedance, usually approximately 100 ohms, that is selected based on physical feature size (e.g., a 50 ohms slot line would be too narrow to accommodate two orthogonal slots because they would physically interfere). A 100 ohm slot may be coupled to an 80 ohm stripline feed, which is in turn transformed down to 50 ohms in the stripline board. This single slot-fed balun configuration offers a coincident phase center yet has separate resonators for the two polarizations, each offset by half a unit cell from the common throat section.

Referring to FIG. 3A, according to one embodiment of the present invention the antenna array 300 includes a radiating portion 302 and a feed portion 304 separated from the radiating portion 302 by a parallel plate layer 306. The radiating portion 302 includes a plurality of flares 310 which are spaced from one another by a unit cell size. The flares 310 are arranged to form notches 380 between the flares. The feed portion 304 includes microstrip feeds (including corresponding excitations) 320 spanning slots 330 which are backed by cavities 340. The feed portion 304 is coupled to the radiating portion 302 through the parallel plate layer 306 such that signals applied to the microstrip feeds (via the corresponding excitations) 320 from a driving circuit are coupled to the radiating portion 302 via the parallel plate section 306 to radiate electromagnetic energy. In addition, electromagnetic waves received by radiating portion 302 are coupled to the microstrip feed lines 320 across the parallel plate layer 306 to be processed by a receiving circuit connected to the microstrip feed lines (via the corresponding excitations) 320.

In the embodiment illustrated in FIG. 3A, the slots 330 are aligned with the center lines of the flares 310 (e.g., along the dotted lines shown in FIG. 3A). Therefore, the slots 330 and the feeds 320 spanning the slots are spaced apart from the notches 380 (and the radiating paths 350) located between the flares 310 and therefore no offset in the z-direction is needed between the radiating elements aligned with the first polarity and the radiating elements aligned with the second polarity, thereby simplifying construction of the apparatus.

The antenna 300 includes two separate assemblies: the radiating portion (also commonly referred to as the radiators) 302 and the feed portion or feeds 304. The radiating portion 302 can be constructed a multiple ways, including: molded (e.g., injection molded) or machined 3-D structures that are attached to a planar surface or sheet with similar footprint (facesheet); or an eggcrate structure formed by interlocking radiator printed circuit cards. The feed portion can be manufactured using standard multilayer printed wiring boards (PWB or printed circuit board) processes. The radiating 302 and feed 304 portions can be physically separated by a parallel plate spacer layer which may include low-dielectric foam layers or by using spacers located at various points between the radiating portion 302 and the feed portion 304 (thereby leaving air or vacuum between the radiator and feed assemblies). The physical space between the radiating portion 302 and the feed portion 304 forms the parallel plate layer 306.

Figure 3B:
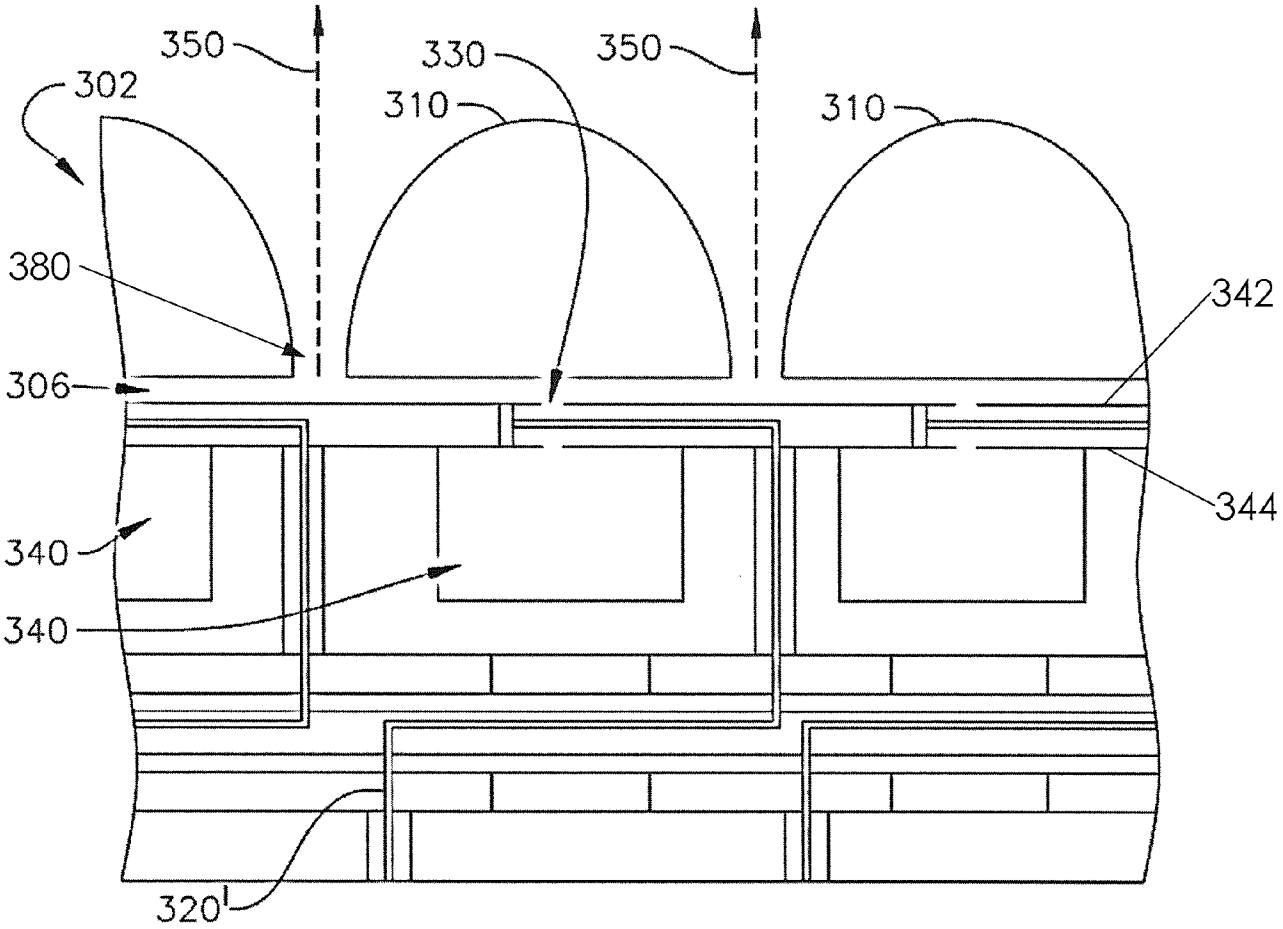
FIG. 3B is a cross sectional view of an embodiment of the present invention similar to the embodiment of FIG. 3A, but having an alternative feed scheme.

FIG. 3B is a cross-sectional view of a coincident phased slot-fed dual polarized antenna array constructed according to an alternative embodiment of the present invention in which the microstrip feeds 320 of the embodiment of FIG. 3A are replaced with stripline feeds (including corresponding excitations) 320' between conducting plates 342 and 344. The use of a stripline feed between conducting plates simplifies construction when compared to the embodiment shown in FIG. 3A, thereby reducing costs.

Figure 3C:
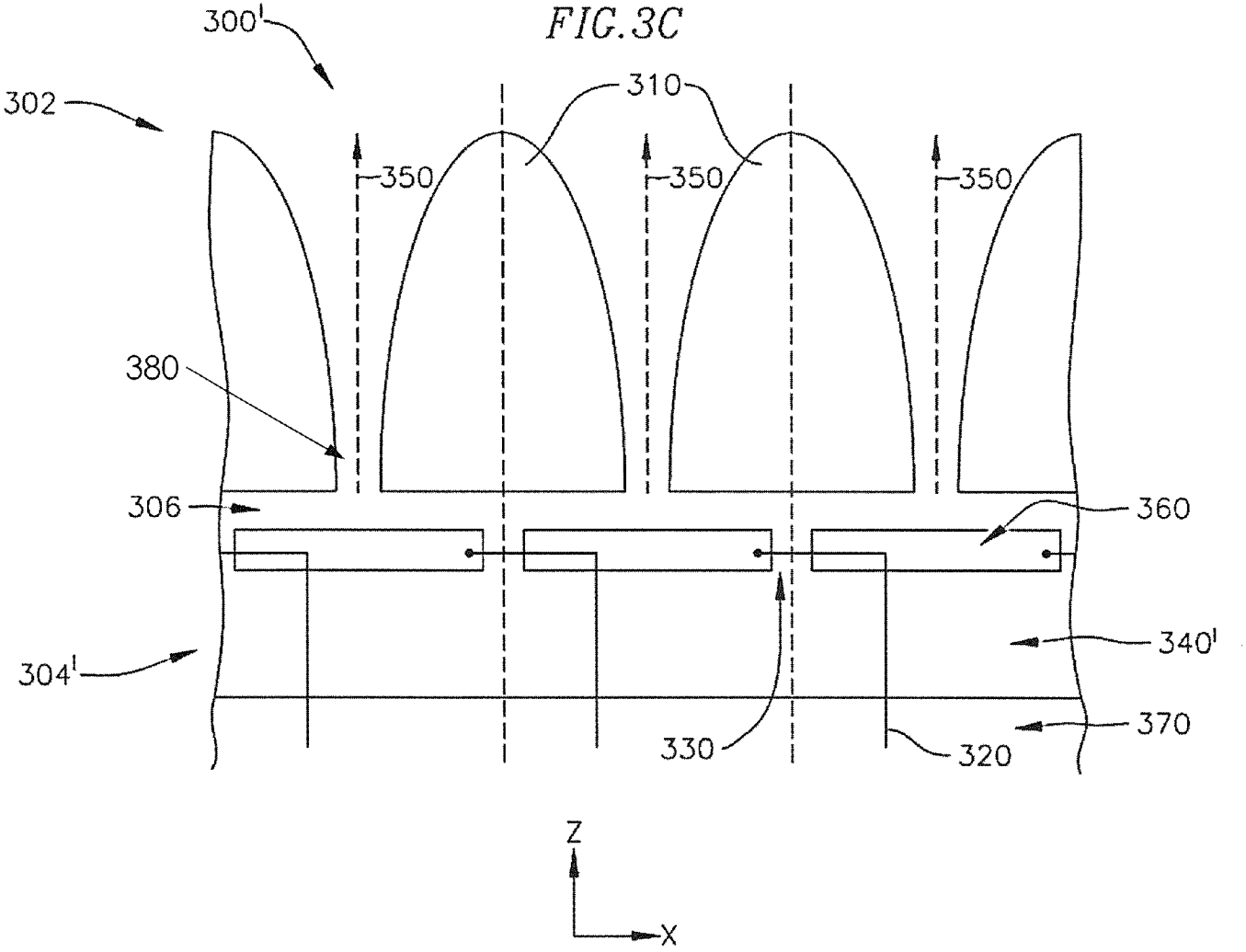
FIG. 3C is a cross sectional view of an embodiment of the present invention similar to the embodiment of FIG. 3A, in which the resonators of FIG. 3A are replaced by a spacer layer backed by a ground plane.

FIG. 3C is a cross-sectional view of another embodiment of the present invention. In the embodiment shown in FIG. 3C, the cavities 340 of the embodiment of FIG. 3A are replaced by a spacer layer 340' backed by a ground plane 370 and therefore does not include a separate cavity for each of the radiating elements. The spacer layer 340' may be filled with an insulating dielectric material or air or vacuum (e.g., when used in outer space). Eliminating separate cavities also simplifies and reduces the cost of manufacturing. At higher operating frequencies, separate cavities also become more difficult to implement due to their small feature sizes.

Figure 3D:
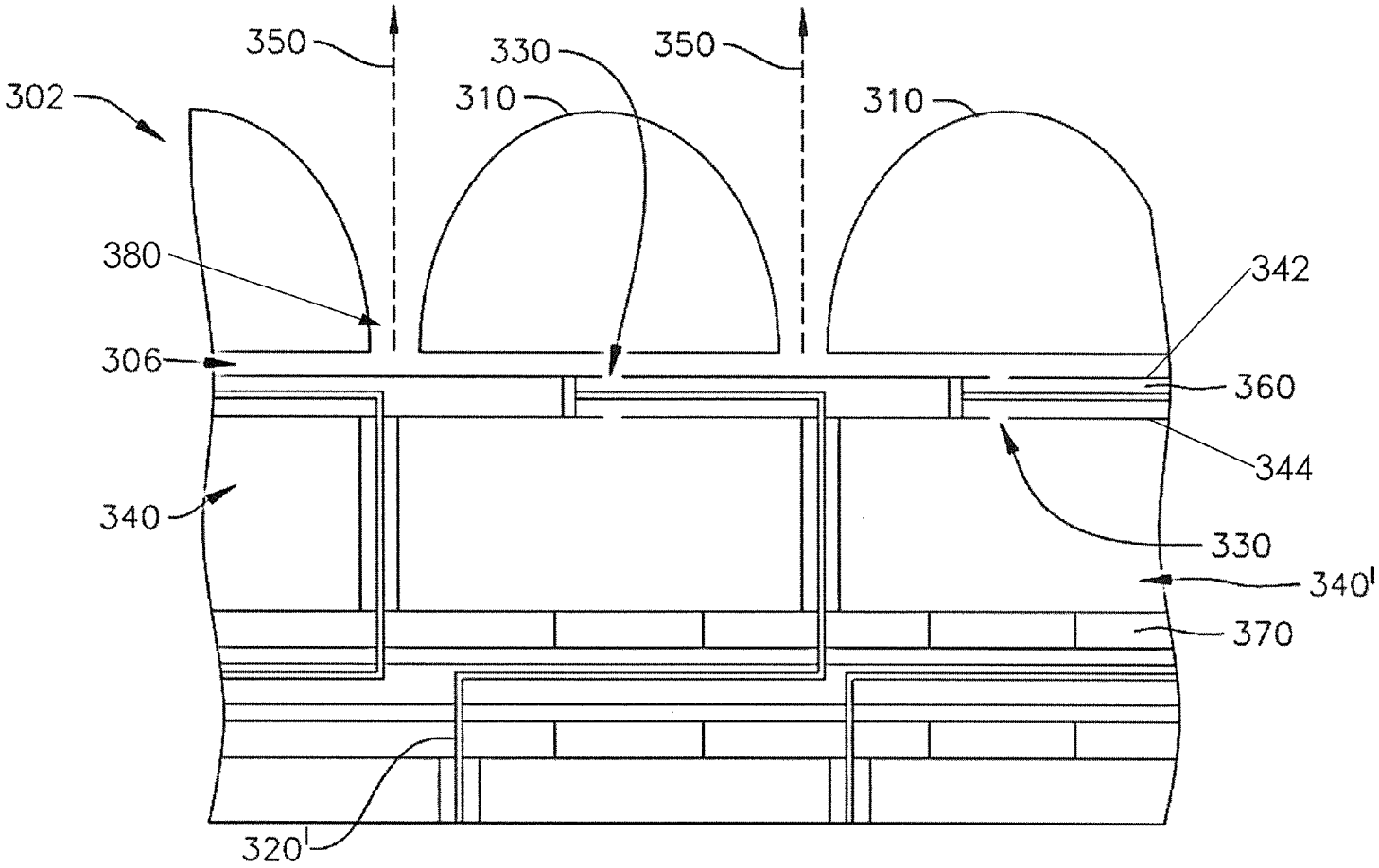
FIG. 3D is a cross sectional view of an embodiment of the present invention similar to the embodiment of FIG. 3B, in which the resonators of FIG. 3B are replaced by a spacer layer backed by a ground plane.

FIG. 3D is a cross-sectional view of another embodiment of the present invention which is a combination of features of the embodiments shown in FIGS. 3B and 3C. In the embodiment shown in FIG. 3D, the cavities 340 of the embodiment of FIG. 3B are replaced by a spacer layer 340' backed by a ground plane 370 and the microstrip feed is replaced with a stripline feed 320' between conducting plates 342 and 344.

Figure 3E:
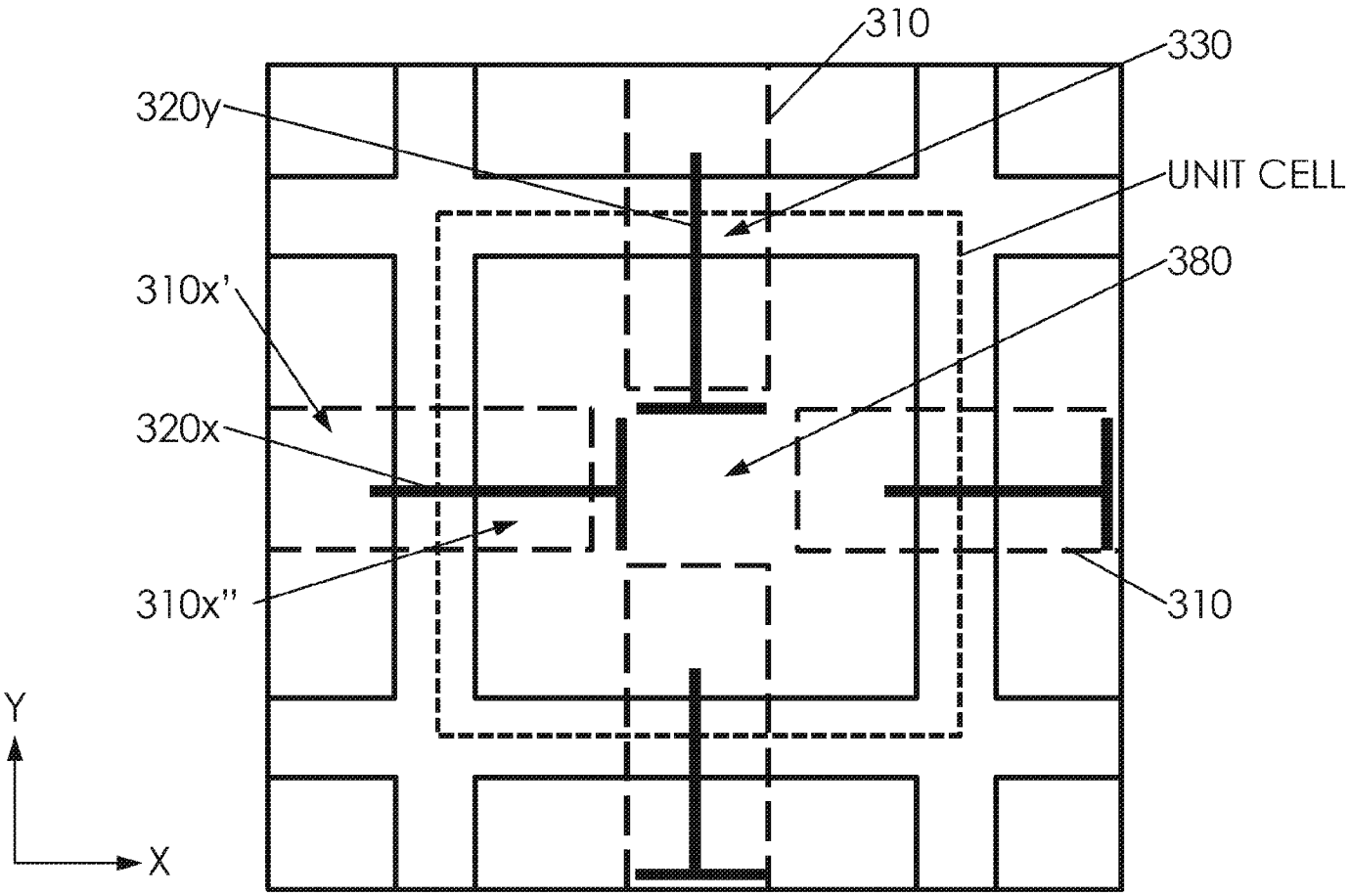
FIG. 3E is a cross sectional plans view of the embodiment illustrated in FIG. 3A, as taken along line E-E of FIG. 3A.

FIG. 3E is a cross sectional plan view of the embodiment of the present invention shown in FIG. 3A, as taken along line E-E of FIG. 3A. As seen in the plan view, the feeds 320 extend across slots 330 located beneath the flares 310 and not beneath the notches 380 between the flares 310. As such, the feeds 320 drive the radiators, which include flares 310, which intersect with one another and that are spaced apart from one another. As seen in FIG. 3E, micro strip line 320*x* is arranged to drive a first radiator arranged along the x axis, the first radiator including a first portion 310*x*' and a second portion 310*x*". Feed 320*y* is spaced apart from feed 320*x* in the x and y directions and therefore, in some embodiments of the present invention, may be located in the same plane as the feed 320*x* (e.g., feed 320*y* may have the same z coordinate as the feed 320*x*).

The embodiments of FIGS. 3A, 3B, 3C, 3D, and 3E are well suited to higher frequency applications in which the antenna height, light weight, and small volume are not critical considerations.

Figure 4A:
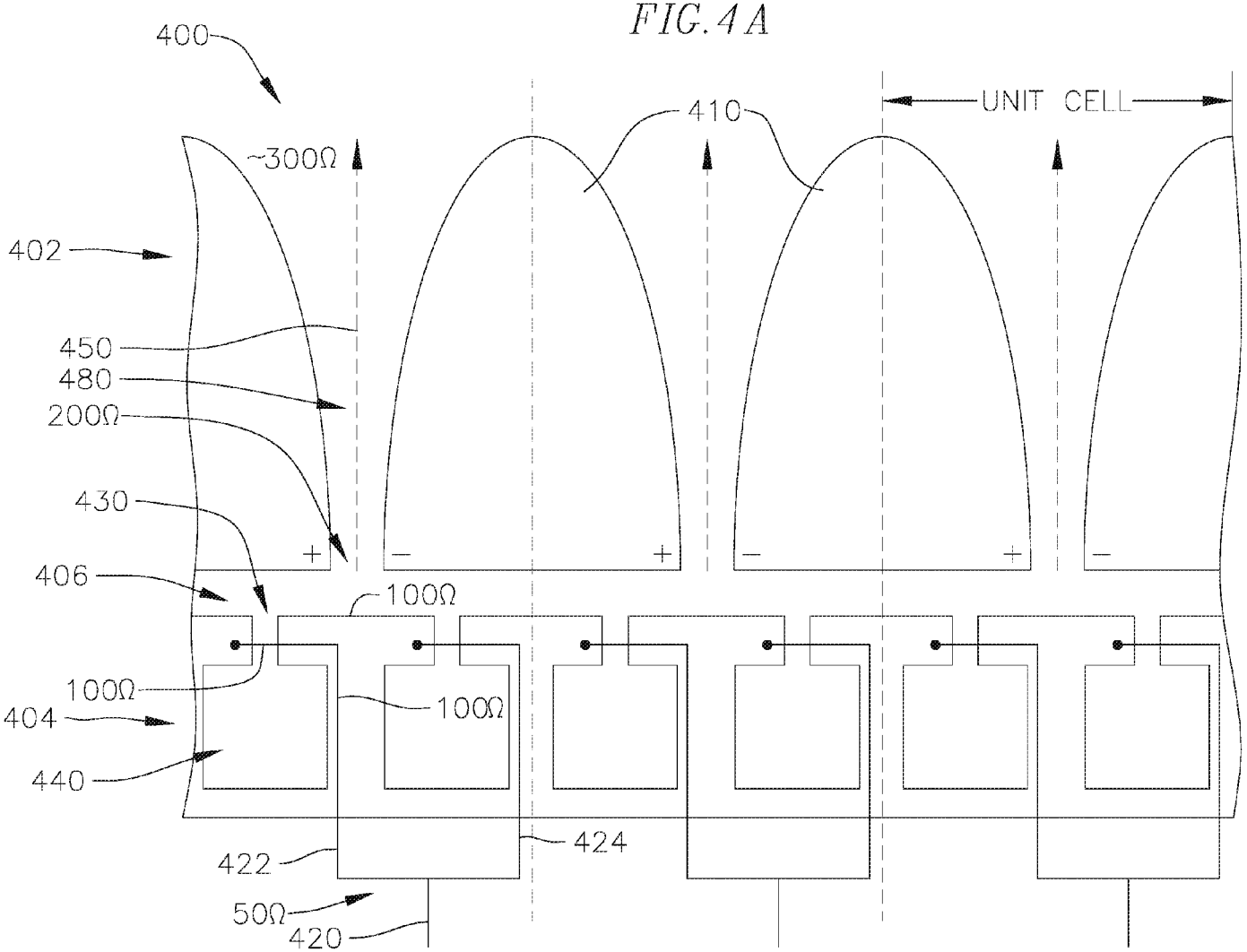
FIG. 4A is a cross sectional view a coincident phased slot fed antenna array according to one embodiment of the present invention.

FIG. 4A is a cross-sectional view of an antenna array according to another embodiment of the present invention which is substantially similar to the embodiment illustrated in FIG. 3A. The embodiment shown in FIG. 4A differs from the embodiment shown in FIG. 3A in that two slots 430 are located beneath each flare 410. Embodiments of the present invention making use of a two slot resonator may be particularly suitable for applications where low profile and weight are most important. The height of the radiating portion 402 can be made significantly shorter by including a power combiner to quickly lower the impedance from free space to component impedance (usually 50 ohms). For example, the height of the flares 410 can be made much shorter by designing the flare impedance transformation to transform from 300 to 200 ohms. The 200 ohms drive points are, in turn, divided down via a parallel plate section to two push-pull resonator sections within the unit cell, each at 100 ohms. The two 100 ohm stripline feeds section are later combined with a reactive power divider to provide the final 50 ohm aperture port. This two-resonator configuration greatly reduces aperture height. In addition, the shorter radiator height also reduces cross-polarization coupling.

Referring to FIG. 4A, a two slot radiator includes a radiating portion 402 and a feed portion 404 separated from the radiating portion 402 by a parallel plate layer 406 and is configured to emit electromagnetic radiation along radiating paths 450. The radiating portion includes a plurality of flares 410 arranged to define a plurality of notches 480 between the flares, where the radiating paths 450 extend along the notches 480. The feed portion 404 includes excitations 420 and each of the excitations 420 is coupled to corresponding feeds including a first feed 422 and a second feed 424. As shown in FIG. 4A, the feed portion also includes a plurality of slots 430 backed by cavities 440, each of the slots 430 being located between a notch 480 and a center line (e.g., the dotted line) of a flare 410. Therefore, the slots 430 are spaced apart from both the center line and the notch 480. In addition, as shown in FIG. 4A, each of the unit cells includes two cavity backed slots 430 (e.g., the cavity backed slots 430 to the immediate left and right of the notch 480) and both of the slots 430 are driven by the same excitation 420. The feed portion 404 is coupled to the radiating portion 402 through the parallel plate layer 406 such that signals applied to the microstrip feeds 422 and 424 from a driving circuit are coupled to the radiating portion 402 via the parallel plate section 406 to radiate electromagnetic energy. In addition, electromagnetic waves received by radiating portion 402 are coupled to the microstrip feeds 422 and 424 across the parallel plate layer 406 to be processed by a receiving circuit connected to the excitation 420.

In addition, in this arrangement, a single radiating element or unit cell (e.g., between two adjacent dotted lines as shown in FIG. 4A) is coupled to two feeds 422 and 424, which are combined to become excitation 420. Assuming each of the feeds 420 has a source impedance of 50Ω, then, the impedance would be 1000 at feeds 422 and 424. At the lower portion of the flares 410 (e.g., the portion adjacent to the layer 406) is 200Ω. As such, the height of the flares 410 may be reduced because the flares are designed to transform the impedance from 200Ω to the free space impedance of 377Ω rather than from 100Ω to 377Ω, or even 50Ω to 377Ω.

Figure 4B:
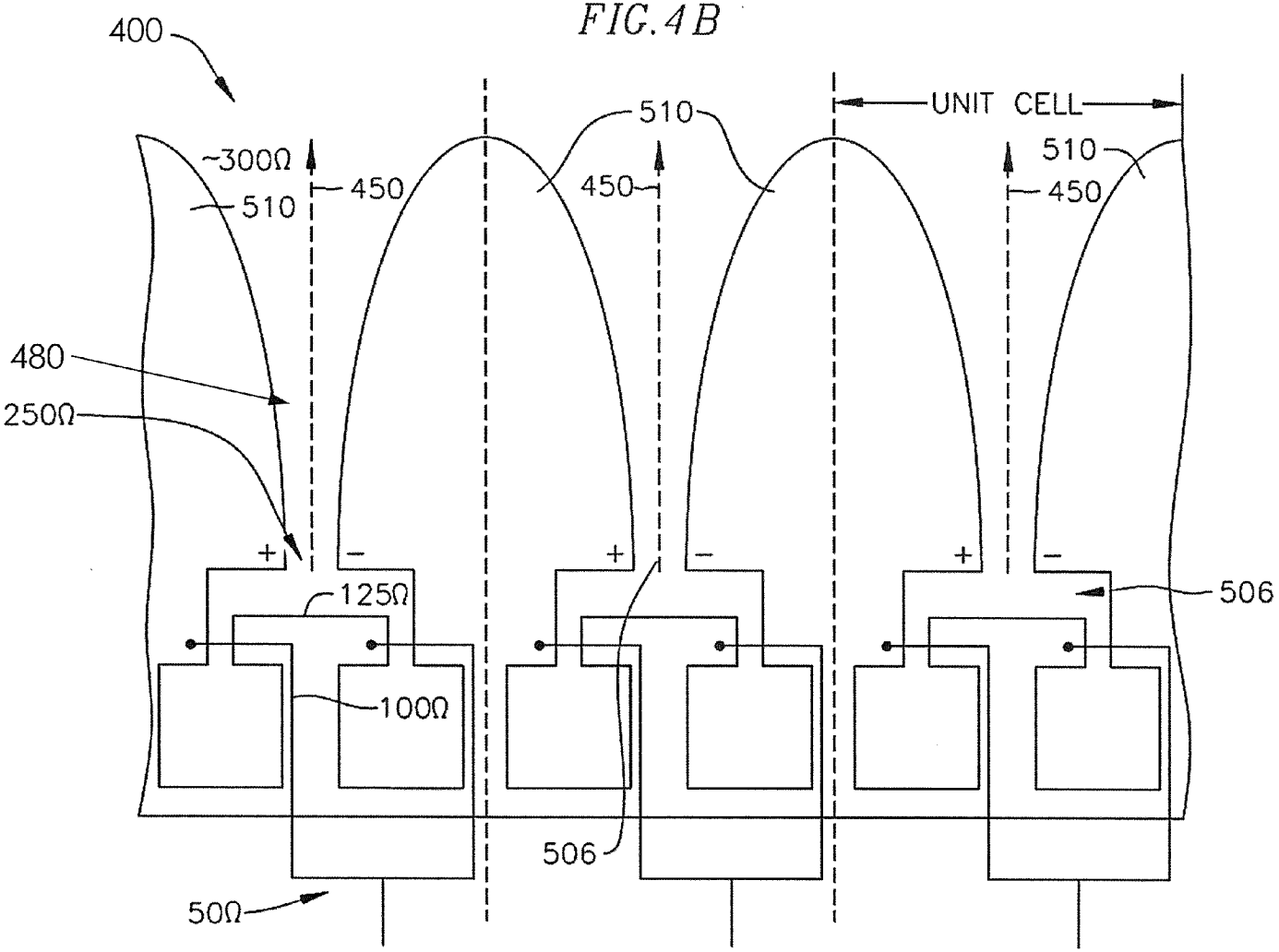
FIG. 4B is a cross sectional view of an embodiment of the present invention similar to the embodiment of FIG. 4A, but having an alternative feed scheme.
Figure 4C:
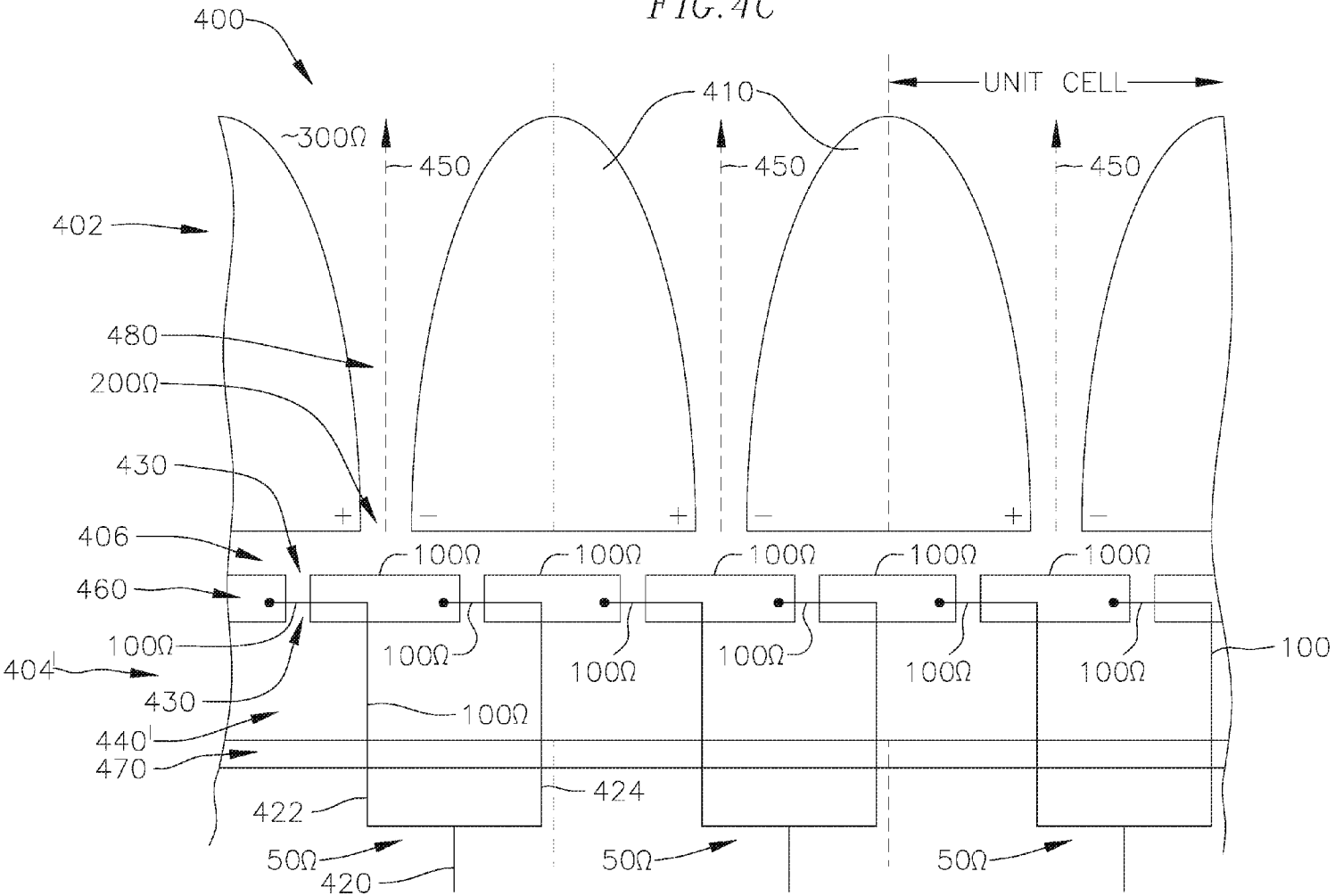
FIG. 4C is a cross sectional view of an embodiment of the present invention similar to the embodiment of FIG. 4A, in which the resonators of FIG. 4A are replaced by a spacer layer backed by a ground plane.

In another embodiment of the present invention, in a manner similar to that of the embodiment describe with respect to FIG. 3C above, FIG. 4C illustrates an embodiment in which the cavities 440 of the embodiment of FIG. 4A are replaced by a spacer layer 440' backed by a ground plane 470.

Figure 4D:
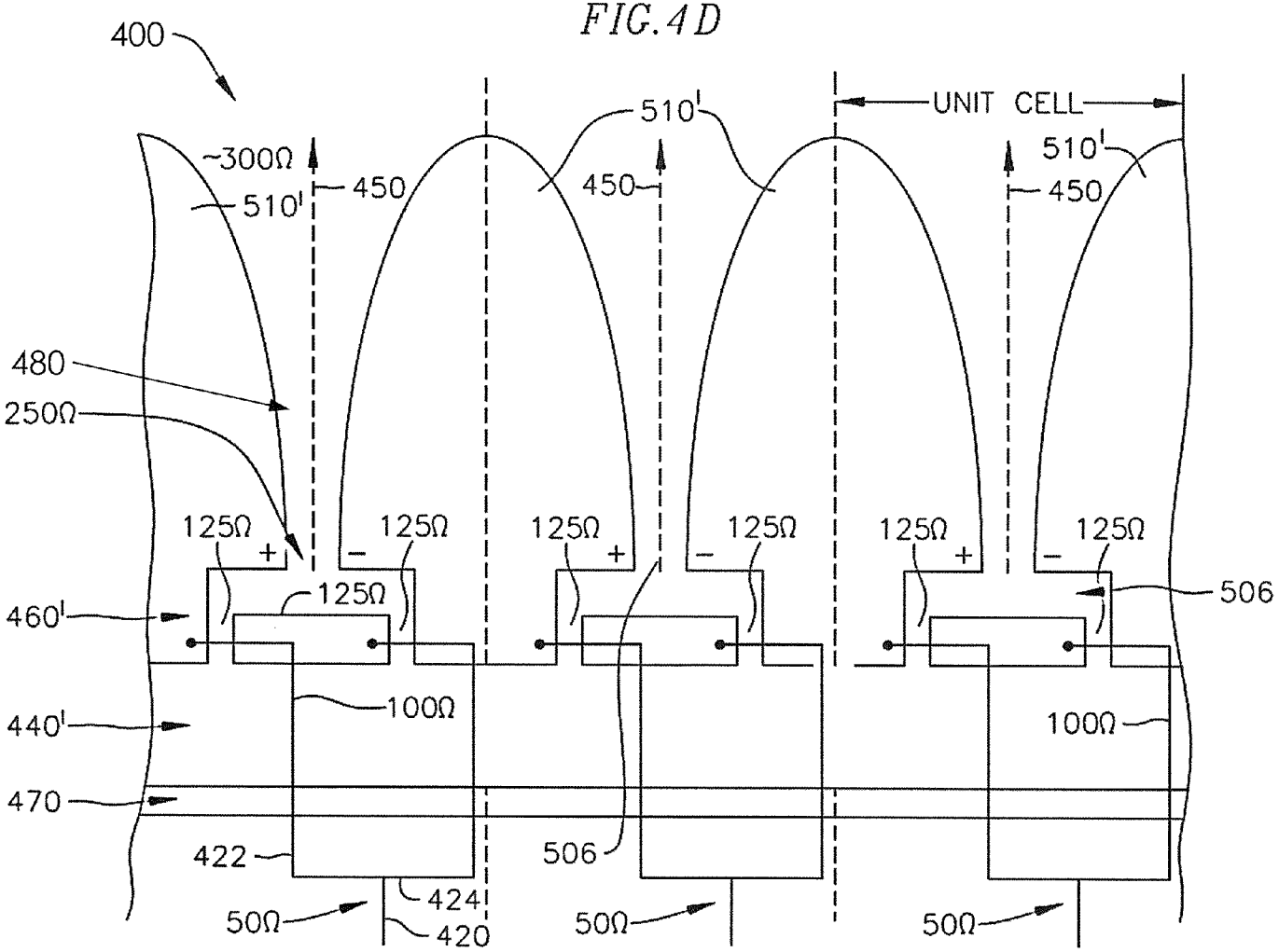
FIG. 4D is a cross sectional view of an embodiment of the present invention similar to the embodiment of FIG. 4B, in which the resonators of FIG. 4B are replaced by a spacer layer backed by a ground plane.

In another embodiment of the present invention similar to that shown in FIG. 3D, as shown in FIG. 4D, the cavities 440 of the embodiment of FIG. 4B are replaced by a spacer layer 440' backed by a ground plane 470 and the microstrip feeds are replaced by stripline feeds between ground plates.

The embodiments of FIGS. 4A, 4B, 4C, and 4D are suited to lower frequency applications in which space and weight constraints do not allow antennas having high profiles.

Similar to the embodiment described above in reference to FIG. 3A, the antenna 400 includes two separate assemblies: the radiating portion (also commonly referred to as the radiators) 402 and the feed portion or feeds 404. The radiating portion 304 can be constructed a multiple ways, including: molded or machined 3-D structures that are attached to a planar surface or sheet with similar footprint (facesheet); or an eggcrate structure formed by interlocking radiator printed circuit cards. The feed portion can be manufactured using standard multilayer printed wiring boards (PWB or printed circuit board) processes. The radiating 402 and feed 404 portions can be physically separated by a parallel plate spacer layer which may include low-dielectric foam layers or by using spacers located at various points between the radiating portion 402 and the feed portion 304 (thereby leaving air or vacuum between the radiator and feed assemblies). The physical space between the radiating portion 402 and the feed portion 404 forms the parallel plate layer 406.

In one embodiment, a 0.5-2 GHz design has been modeled with 4" (about 10 cm) total height, using 2.2" (about 5.6 cm) lattice spacing. According to another embodiment, a 0.5 to 3.3 GHz design is 5.2" (about 13 cm) tall, using 1.5" (about 3.8 cm) lattice spacing.

Figure 5A:
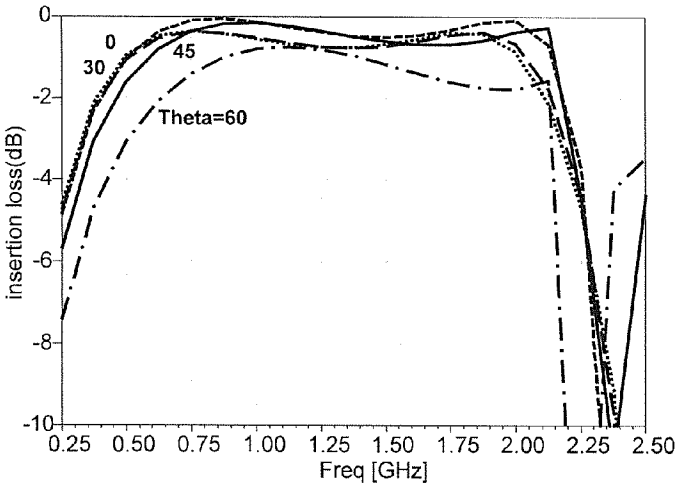
FIGS. 5A, 5B, and 5C illustrate calculated co-polarization insertion loss from 0.25 GHz to 2.50 GHz for H-Plane, E-Plane, and D-Plane scans, respectively in one embodiment of the present invention.
Figure 5B:
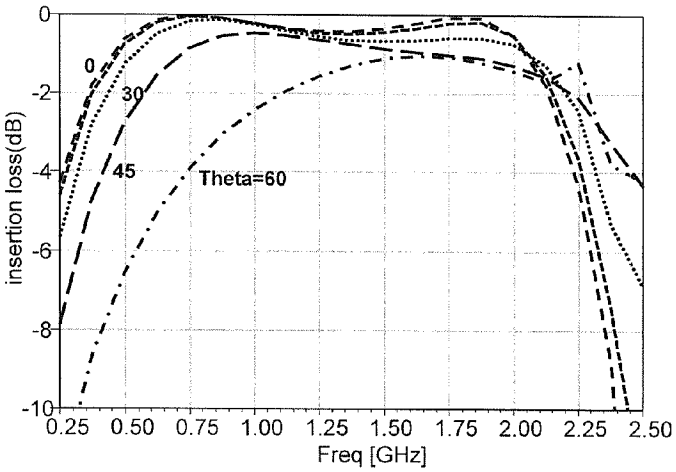
Figure 5C:
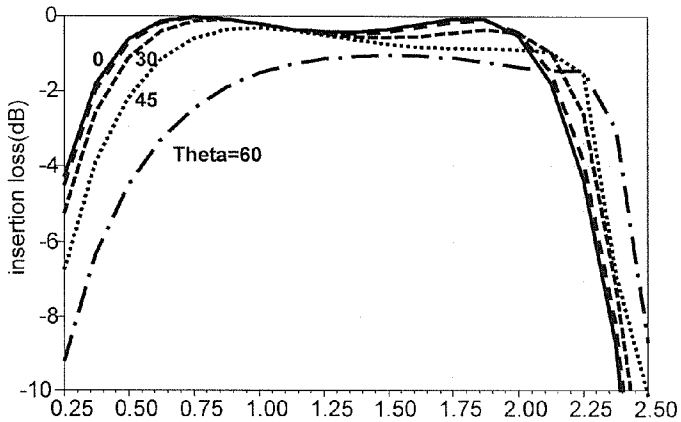

FIGS. 5A, 5B, and 5C illustrate calculated co-polarization insertion loss from 0.25 GHz to 2.50 GHz for H-Plane, E-Plane, and D-Plane scans, respectively, in the dual-slot embodiments of the present invention as illustrated in FIGS. 4A, 4B, 4C, and 4D. E (or H)-cut is for the case that the radiation is scanned along the E (or H)—field plane. In other words, for a vertically polarized element, the vertical plane is the E-plane, and horizontal plane would be its H-plane. As shown in FIGS. 5A, 5B, and 5C, excellent scan performance in provided at up to 45 degrees.

Figure 6A:
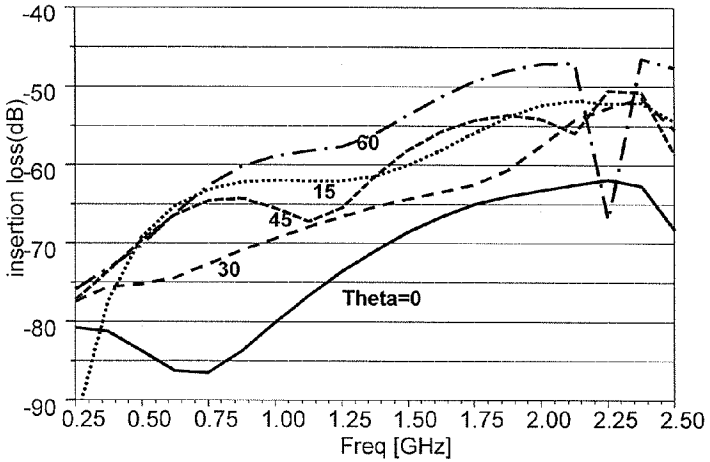
FIGS. 6A, 6B, and 6C illustrate calculated Cx-polarization insertion loss, not including aperture projection loss from 0.25 GHz to 2.50 GHz for H-Plane, E-Plane, and D-Plane scans, respectively, according to one embodiment of the present invention.
Figure 6B:
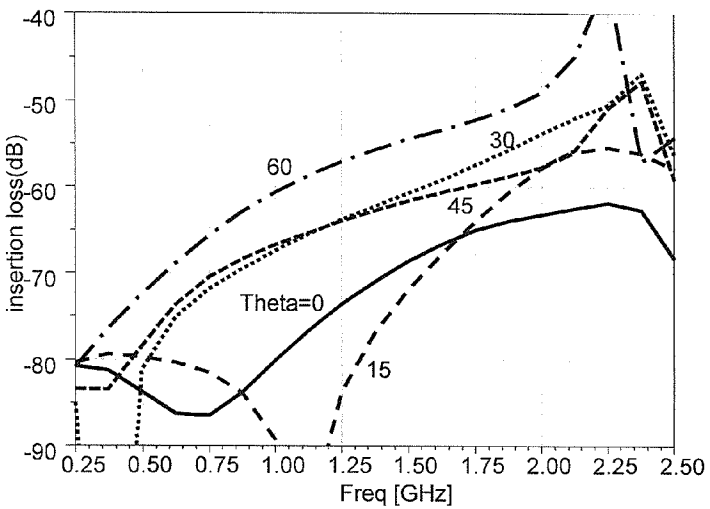
Figure 6C:
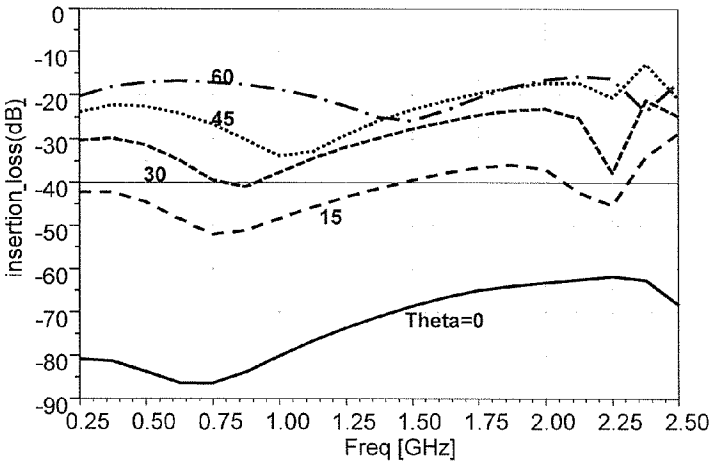

FIGS. 6A, 6B, and 6C illustrate calculated Cx-polarization insertion loss, not including aperture projection loss from 0.25 GHz to 2.50 GHz for H-Plane, E-Plane, and D-Plane scans, respectively, in the dual-slot embodiments of the present invention as illustrated in FIGS. 4A, 4B, 4C, and 4D. As shown in FIGS. 6A, 6B, and 6C, Cx-polarization levels are low, even at 60 degrees.

Figure 7B:
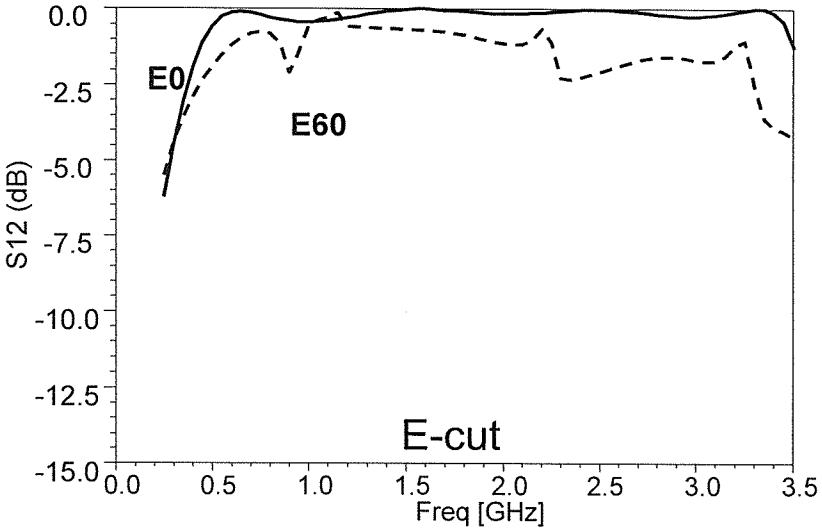
FIGS. 7A and 7B illustrated calculated co-polarization insertion loss along the E-Plane and the H-Plane according to one embodiment of the present invention.
Figure 7A:
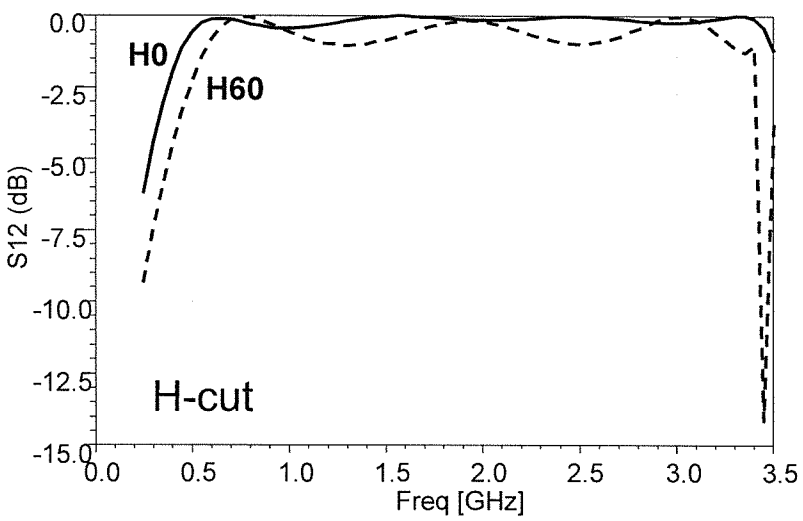

FIGS. 7A and 7B illustrate calculated co-polarization insertion loss (just like FIGS. 5A, 5B) for one embodiment of the present invention, in the 0.5-3.3 GHz embodiment described above, which has a different and longer radiating aperture.

In one embodiment of the present invention, the flares and radiators are made of a metalized molded (e.g., injection molded) plastic. Flares and radiators according to these embodiments can be made according to a plastic molding process. In such an embodiment, discrete metalized molded flared tops (e.g., corresponding to the flares) are bonded to a facesheet to form the radiating apertures, and the facesheet is then bonded over the separately-formed feed portion. The facesheet would be a thin dielectric layer with the same pattern (the footprint of the radiating elements) on both sides. Multiple plated thru vias would connect the top and bottom metal patterns. These metalized molded flared tops would get bonded conductively over these patterns.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A coincident phased dual-polarized antenna array configured to emit electromagnetic radiation, the antenna array comprising:

a plurality of electromagnetic radiators arranged in a grid, the plurality of electromagnetic radiators defining a plurality of notches therebetween, the plurality of notches being spaced apart from one another along a first direction and a second direction of the grid, the plurality of electromagnetic radiators defining a plurality of corresponding cells, each cell having a first notch arranged in a middle of the cell along the first direction and a second notch arranged in the middle of the cell along the second direction;

a ground plane spaced from the electromagnetic radiators;

a conductive layer disposed between the electromagnetic radiators and the ground plane, the conductive layer having a plurality of slots laterally offset from the notches and being spaced apart from and electrically insulated from the electromagnetic radiators, the plurality of slots being spaced apart from one another at a side of a respective cell and at a center line of a respective electromagnetic radiator along the first direction and the second direction;

a plurality of feeds, each of the feeds spanning a corresponding slot of the slots and electrically connected to a portion of the conductive layer at one side of the corresponding slot, the plurality of feeds comprising first feeds extending along the first direction and second feeds extending along the second direction, the first feeds being spaced apart from the second feeds along the first direction and the second direction;

a plurality of first excitations coupled to corresponding ones of the first feeds and configured to drive the cells separately from one another; and a plurality of second excitations coupled to corresponding ones of the second feeds and configured to drive the cells separately from one another.

2. The coincident phased dual-polarized antenna array of claim 1, wherein the ground plane is spaced from the conductive layer.

3. The coincident phased dual-polarized antenna array of claim 1, wherein a spacer layer is between the plurality of slots and the ground plane.

4. The coincident phased dual-polarized antenna array of claim 3, wherein the spacer layer is filled with a dielectric material.

5. The coincident phased dual-polarized antenna array of claim 1, further comprising a plurality of cavities between the plurality of slots and the ground plane and arranged below respective slots at the center line of respective electromagnetic radiators.

6. The coincident phased dual-polarized antenna array of claim 5, wherein the cavities are filled with a dielectric material.

7. The coincident phased dual-polarized antenna array of claim 1, wherein the conductive layer is spaced apart from the electromagnetic radiators by an electrically insulating parallel plate layer.

8. The coincident phased dual-polarized antenna array of claim 7, wherein the electrically insulating parallel plate layer is filled with a dielectric material.

9. The coincident phased dual-polarized antenna array of claim 1, wherein one of the slots is located between adjacent ones of the notches.

10. The coincident phased dual-polarized antenna array of claim 1, wherein two of the slots are located between adjacent ones of the notches.

11. The coincident phased dual-polarized antenna array of claim 10, wherein a first of the feeds spanning a first slot of the slots is electrically coupled in parallel to a second of the feeds spanning a second slot of the slots, wherein the first slot is adjacent to the second slot, and wherein the first slot and the second slot are on opposite sides of a notch of the notches.

12. The coincident phased dual-polarized antenna array of claim 1, wherein the electromagnetic radiators comprise metalized molded plastic flares.

13. The coincident phased dual-polarized antenna array of claim 1, wherein the feeds are microstrip feeds.

14. The coincident phased dual-polarized antenna array of claim 1, wherein the feeds are stripline feeds.

15. A method of emitting electromagnetic radiation along a plurality of radiating paths, the method comprising:

providing a plurality of electromagnetic radiators arranged in a grid, the plurality of electromagnetic radiators defining a plurality of notches therebetween, the plurality of notches being spaced apart from one another along a first direction and a second direction of the grid, the plurality of electromagnetic radiators defining a plurality of corresponding cells, each cell having a first notch arranged in a middle of the cell along the first direction and a second notch arranged in the middle of the cell along the second direction;

providing a ground plane spaced from the electromagnetic radiators;

providing a conductive layer between the electromagnetic radiators and the ground plane, the conductive layer having a plurality of slots laterally offset from the notches and being spaced apart from and electrically insulated from the electromagnetic radiators, the plurality of slots being spaced apart from one another at a side of a respective cell and at a center line of a respective electromagnetic radiator along the first direction and the second direction;

providing a plurality of feeds, each of the feeds spanning a corresponding slot of the slots and electrically connected to a portion of the conductive layer at one side of the corresponding slot, the plurality of feeds comprising first feeds extending along the first direction and second feeds extending along the second direction, the first feeds being spaced apart from the second feeds along the first direction and the second direction;

providing a plurality of first excitations coupled to corresponding ones of the first feeds and configured to drive the cells separately from one another;

providing a plurality of second excitations coupled to corresponding ones of the second feeds and configured to drive the cells separately from one another; and supplying a plurality of electromagnetic signals to the first feeds through corresponding excitations of the first excitations and to the second feeds through corresponding excitations of the second excitations.

16. The method of emitting electromagnetic radiation of claim 15, wherein two of the slots are located between adjacent ones of the notches.

17. The method of emitting electromagnetic radiation of claim 16, wherein a first of the feeds spanning a first slot of the slots is electrically coupled in parallel with a second of the feeds spanning a second slot of the slots, wherein the first slot is adjacent to the second slot, wherein the first slot and the second slot are on opposite sides of a radiating path of the radiating paths, and wherein a same electromagnetic signal of the electromagnetic signals is supplied to the first micro strip line or strip line feed and the second micro strip line or strip line feed.

18. The method of emitting electromagnetic radiation of claim 15, wherein the feeds are microstrip feeds.

19. The method of emitting electromagnetic radiation of claim 15, wherein the feeds are stripline feeds.

20. The method of emitting electromagnetic radiation of claim 15, further comprising providing a spacer layer or a plurality of cavities between the plurality of slots and the ground plane.

* * * * *